United States Patent [19]

Bayly

[11] 4,041,651

[45] Aug. 16, 1977

BEST AVAILABLE COPY

[54] KNIFE SHARPENER

[75] Inventor: Peter Kingsley Bayly, Eltham North, Australia

[73] Assignee: Wiltshire Cutlery Company Proprietary Ltd., Australia

[21] Appl. No.: 715,003

[22] Filed: Aug. 17, 1976

[30] Foreign Application Priority Data

Aug. 22, 1975 Australia ..... 2893/75

[51] Int. Cl.[2] ..... B24B 3/54

[52] U.S. Cl. ..... 51/214; 51/204; 76/82

[58] Field of Search ..... 30/138; 51/204, 205 WG, 51/214; 76/82, 86, 88

[56] References Cited

U.S. PATENT DOCUMENTS

| | | | |
|---|---|---|---|
| 2,444,110 | 6/1948 | Pavesi | 76/88 |
| 3,676,961 | 7/1972 | Jackson | 51/214 |
| 3,774,350 | 11/1973 | Bayly | 51/214 X |
| 3,861,246 | 1/1975 | Waller | 51/214 X |

*Primary Examiner*—Gary L. Smith

*Attorney, Agent, or Firm*—Diller, Brown, Ramik & Wight

[57] ABSTRACT

A knife sharpener of the kind having a hollow scabbard or housing for a knife blade, and a blade sharpening device arranged to be engaged by the blade cutting edge as the blade is moved into and out of the housing. The sharpening device is mounted on the front end of a carrier member which has its rear end pivotally connected to the housing so that the front end can be swung towards and away from a top wall of the housing. A biasing spring urges the front end of the carrier towards the housing top wall. A reaction member is disposed between that housing top wall and the carrier member and is pivotally connected to the housing for movement about an axis which is parallel to the carrier pivot axis and is located between the ends of the reaction member. A rear end of the reaction member engages an upper surface of the carrier member at a location between the carrier pivot and the zone at which the biasing spring acts on the carrier member. The front ends of the carrier and reaction members are separated when a knife blade is inserted into the housing, but the engagement at their rear ends is maintained at all times.

4 Claims, 9 Drawing Figures

KNIFE SHARPENER

This invention relates to knife blade sharpeners, and is particularly concerned with such sharpeners as embodied in a scabbard or protective sheath for a knife blade. Such sharpener-scabbard combinations form the subject of U.S. Pat. Nos. 3,676,961 and 3,774,350.

A problem with the prior constructions arises from the fact that they do not sharpen the complete length of the blade cutting edge. That deficiency affects the usefulness of such constructions in relation to kitchen and industrial knives which utilize the full length of the cutting edge — e.g., when used for chopping. A further problem with prior sharpeners of the king in question, is that they are not suitable for use with a wide range of blade depths, and in particular are generally limited to use with relative shallow blades. Many "chopping" knives for example, have relatively deep blades and consequently cannot be accommodated by the prior sharpeners.

It is a principal object of the present invention to provide a sharpener-scabbard combination which does permit full length blade sharpening. It is a further object of the invention to provide a sharpener-scabbard combination which is usable with relatively deep knife blades and which can be used with blades of a wide range of depths.

A sharpener in accordance with the invention has a basic construction similar to that shown and described in U.S. Pat. No. 3,774,350. That is, the sharpener includes a hollow housing, a carrier member pivotally mounted in the housing and supporting a sharpening device, and a reaction member adapted to co-act with a knife blade inserted into the housing. In the prior construction, the reaction member is attached to the carrier member so that the depth of a knife blade usable with the sharpener is limited by the permissible relative movement between those two members. In the construction of the present invention however, the carrier and reaction members are separate and can be moved apart a substantial distance to accept knife blades of substantial depth.

In the following passages of this specification, relative terms such as "upper" and "lower" will be used in describing an embodiment of the invention. Such terms are used for convenience only, and are not to be understood as placing a limitation on the way in which the sharpener is to be disposed when in use.

According to the present invention, there is provided a knife sharpener including: a hollow elongate housing having an access opening at a front end thereof; a carrier member located within said housing so as to extend generally lengthwise thereof and having a rear end portion pivotally connected to the housing at a location spaced rearwardly from said access opening, the axis of said carrier pivot extending transverse to the longitudinal axis of said housing so that pivotal movement of said carrier casuses a front end portion thereof to be moved away from and towards an upper wall of said housing; a sharpening device mounted on said carrier front end portion adjacent said access opening; biasing means urging said carrier member to pivot towards said housing upper wall; and a reaction member at least partially located within said housing so as to be disposed between the upper surface of said carrier member and said housing upper wall and being pivotally connected to said housing for movement about an axis extending substantially parallel to said carrier pivot axis and which is located between the last said axis and said access opening; said reaction member having a rear section engaging said carrier uppper surface at a location between the two said pivots, and a front end portion overlying that upper surface adjacent said access opening; the arrangement being such that a knife blade inserted into said housing through said access opening and engaging said sharpening device, causes separation of the front end portions of the two said members, but said rear section of the reaction member remains in engagement with said carrier member during the resulting pivotal movement of each of the two members.

The essential features of the invention, and further optional features, are described in detail in the following passages of the specification which refer to the accompanying drawings. The drawings however, are merely illustrative of how the invention might be put into effect, so that the specific form and arrangement of the features (whether they be essential or optional features) shown is not to be understood as limiting on the invention.

Figure 1:
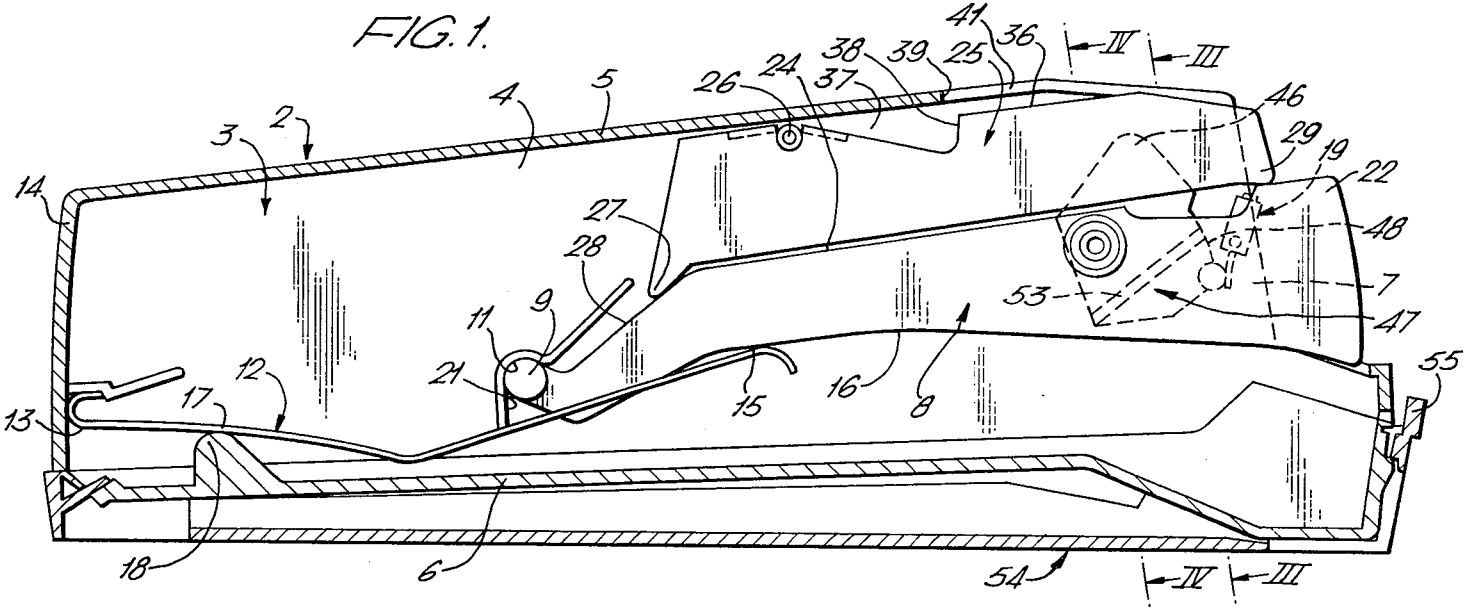
FIG. 1 is a longitudinal cross-sectional view showing an embodiment of the invention in which the various parts are shown in the positions they adopt when a knife blade is not inserted into the scabbard housing.

The scabbard housing 2 shown in the drawings may be generally as described in U.S. Pat. No. 3,774,350. In particular, the knife receiving passage 3 is defined between opposed side walls 4, a top wall 5, and a base 6 of the housing 2, and an access opening 7 is provided at a front end of the housing 2. The carrier 8 is an elongated member which is located in the knife receiving passage 3 so as to extend generally lengthwise thereof, and is pivotally connected to the housing 2 at a location remote from the access opening 7. It is desirable, but not essential, that the pivot connection be constructed as shown in the drawings — i.e., it includes a cylindrical section 9 formed integral with or attached to an inner or rear end of the carrier member 8, and co-operable recesses 11 in each of the two side walls 4 of the housing 2. Each recess 11 preferably opens downwardly towards the housing base 6 as shown so that the cylindrical pivot section 9 can be cleared from the recesses 11 to free the carrier member 8 for withdrawal from the housing 2 through the access opening 7. A biasing spring 12 normally retains the pivot section 9 in the recesses 11, and in the preferred construction shown, it also serves to urge the front or outer end of the carrier 8 towards the upper wall 5 of the housing 2.

Any suitable biasing spring 12 may be used, but in the construction shown a leaf spring is used, and that is retained at one end 13 located at or adjacent the rear end wall 14 of the housing 2, and has its opposite end portion 15 engaging the underside 16 of the carrier 8. It is a further aspect of the preferred spring arrangement shown, that an intermediate portion 17 of the spring 12 engages a projection 18 upstanding from the housing base 6 so as to provide a reaction between the spring 12 and housing 2, and as shown the zone of that reaction is preferably located between the rear end wall 14 and the pivotal connection of the carrier 8.

In the particular construction shown, the front end portion 15 of the spring 12 slidably engages the carrier 8 to permit variation of the zone of that engagement during swinging movement of the carrier 8 about the pivot section 9. The arrangement is such that the pivot section 9 is located between the zones at which the spring 12 engages the housing base 6 and the carrier 8 respectively — i.e., when viewed in the longitudinal direction of the housing passage 3. Furthermore, when there is no knife blade located within the housing 2 as shown in FIG. 1, the biasing spring 12 functions to retain the carrier 8 in its uppermost position — that is, the position at which it is located close to the upper wall 5 of the housing 2.

The carrier pivot arrangement described, is such that the pivot section 9 of the carrier 8 is capable of downward movement relative to the overlying curved bearing surfaces of the co-operting recesses 11, thereby increasing the space between the inner end of the carrier 8 and the upper wall 5 of the housing 2. The facility for such movement serves to guard against the sharpening device 19 being able to "jump" clear of a knife blade when the blade is inserted quickly into the scabbard housing 2, and as a secondary advantage it might also aid in permitting entry of relatively deep blades into the housing 2. Rearward travel of the carrier 8 during such movement is prevented by retainer surfaces 21, each of which preferably forms a continuation of a respective curved bearing surface 11 at the rear side thereof, and extends transverse to the housing base 6. Thus, the pivot section 9 of the carrier 8 bears against those retainer surfaces 12 during movement away from and towards the curved bearing surfaces 11.

The carrier pivot section 9 may be spaced any suitable distance from the rear wall 14 of the housing 2, and is preferably located relative to the various reaction zones of the biasing spring 12 so that there is no substantial change in the distance between the pivot section 9 and the spring end 15, during pivotal movement of the carrier 8. With that relationship, substantially constant pressure is able to be applied to a knife blade engaging the sharpening device 19.

Figure 2:
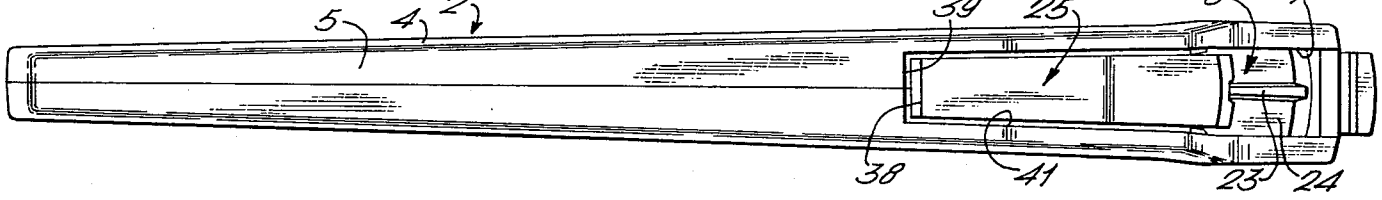
FIG. 2 is a top plan view of the construction shown in FIG. 1.
Figure 3:
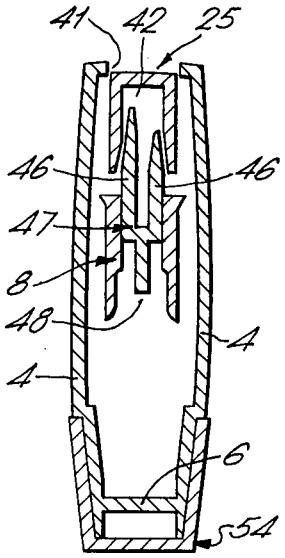
FIGS. 3 and 4 are transverse cross-sectional views taken along lines III—III and IV—IV respectively of FIG. 1.
Figure 4:
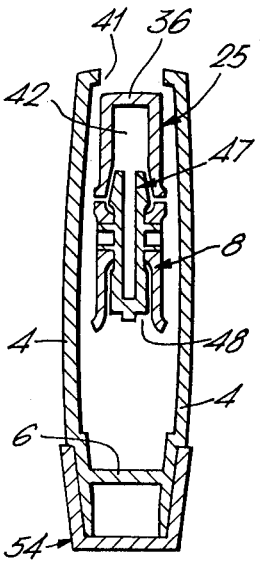
Figure 6:
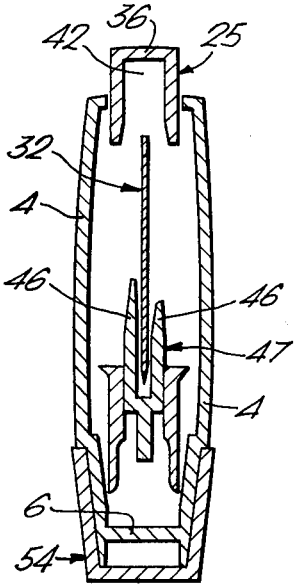
FIGS. 6 and 7 are similar to FIGS. 3 and 4 but are taken along lines VI—VI and VII—VII respectively of FIG. 5.
Figure 7:
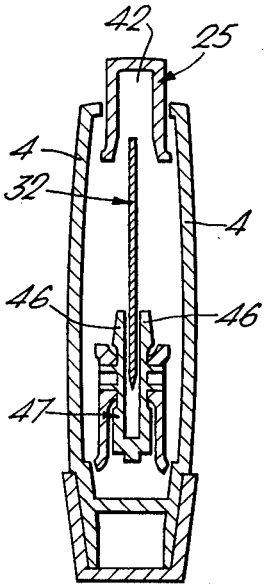

As in the prior construction of U.S. Pat. No. 3,774,350, the front end 22 of the carrier 8 is preferably accessible at the front of the housing 2 so as to permit withdrawal of the carrier 8 for replacement or repair, and the sharpening device 19 is mounted on the carrier 8 at a position adjacent the housing access opening 7. The device 19 is preferably pivotally mounted as in the prior construction, and can be formed in any suitable manner — for example, as is described in either of U.S. Pat. Nos. 3,774,350 and 3,676,961. Also, the sharpening recess (not shown) of the sharpening device 19 is preferably disposed within a guide slot or groove 23 formed in the uppermost surface 24 of the carrier 8 (see FIG. 2).

The reaction member 25 is located between the upper wall 5 of the housing 2 and the adjacent upper surface 24 of the carrier 8, and is pivotally connected to the housing 2 at 26 for movement about an axis extending substantially parallel to the axis of the carrier pivot 9. The location of the pivotal connection 26 is preferably adjacent the housing upper wall 5 as shown and some distance inwardly of the access opening 7 — in the example shown, that distance is substantially the same as the distance between the access opening 7 and the biasing spring 15. A downwardly projecting rear section 27 of the reaction member 25 is arranged to engage a part 28 of the carrier upper surface 24, at a location between the carrier pivot 9 and the zone of engagement between the carrier 8 and the biasing spring end 15. The engagement between the members 8 and 25 is preferably in the form of simple abutment so that there can be relative sliding movement between the section 27 and the surface part 28 as the members 8 and 25 swing about their respective pivots 9 and 26. A front end portion 29 of the reaction member 25 is engageable with the upper edge 31 of a knife blade 32 inserted into the carrier guide slot 23 and beneath that front end portion 29 (see FIG. 5).

Figure 9:
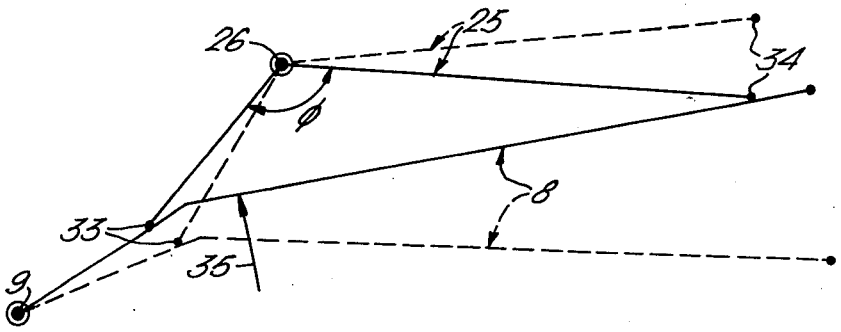
FIG. 9 is a force diagram which applies to the construction shown in the preceding FIGS.

It follows from the foregoing that, in use, the reaction member 25 has a three point reaction. The reaction point defined by the pivot 26 is fixed in location and is intermediate the other two reaction points 33 and 34 (see FIG. 9), which are associated with the carrier 8 and the knife blade 32 respectively and which change location as the knife blade 32 is moved into or out of the housing 2. For optimum results, however, in all pivotal positions of both the reaction member 25 and the carrier 8. the reaction member 25 should engage the carrier 8 at a location which is closer to the carrier pivot 9 than is the line of action 35 (see FIG. 9) along which the biasing spring end 15 acts on the carrier 8. Also, the three points of reaction 26, 33 and 34 should preferably be arranged so that two straight lines joining the intermediate point 26 to the other two, 33 and 34, subtends an angle $\phi$ which is less than 180° (preferably in the range 120°–130° inclusive).

The front end portion 29 of the reaction member 25 is preferably located as shown in FIG. 1 so as to engage or lie close to the adjacent upper surfaces 24 of the carrier 8 when there is no knife blade interposed between the members 9 and 25. Furthermore, that front end portion 29 is preferably located slightly forward of or adjacent to the sharpening device 19, as is also shown in FIG. 1. Thus, in the rest or closed condition of the scabbard as shown in FIG. 1, there is little or no space between the reaction member 25 and the carrier 8 at the front of the housing 2. It is further preferred that, in the same condition of the scabbard, there is little space between the housing upper wall 5 and the adjacent surface 36 of the reaction member 25. That may be achieved as shown by having a recess 37 in the upper surface 36 which underlies the housing wall 5 so as to receive part of that wall 5 as the reaction member 25 is lifted, and forming an upward step 38 in that upper surface 36 forwardly of the front edge 39 of the housing upper wall 5 (see FIGS. 1 and 5). Still further, the front edge 39 of the upper wall 5 may be located some distance back from the front of the side walls 4 so as to provide an opening 41 (FIGS. 1 and 2) through which the reaction member 25 can project, thereby permitting maximum separation of the reaction member 25 and the carrier 8 so that knife blades of substantial depth can be accommodated.

Figure 8:
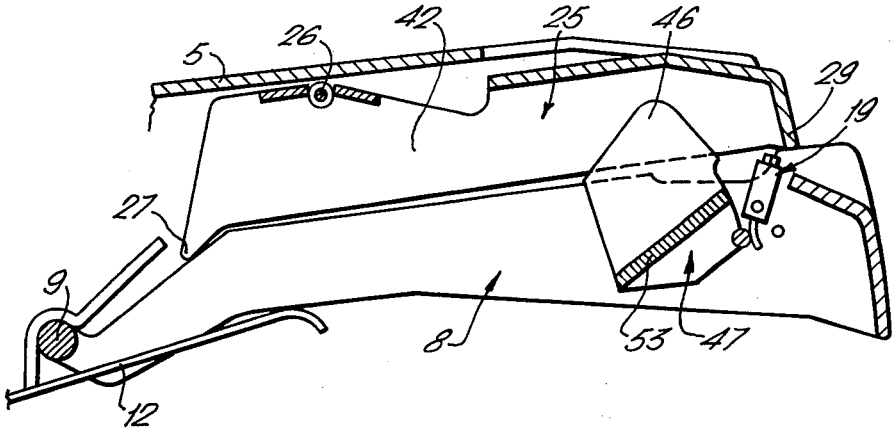
FIG. 8 is a longitudinal sectional view taken along line VIII—VIII of FIG. 2.

In the preferred construction shown, the reaction member has a slot 42 extending through the rear end 43 and the lower surface 44 (see FIGS. 3 to 8), except for a part 45 (FIG. 8) of the lower surface 44 defined by the front end portion 29. The slot 42 receives the upper portion of the knife blade 32 as it is inserted into the scabbard, and permits projection of that blade 32 beyond the rear end 43 of the reaction member 25 (see FIG. 5).

Figure 5:
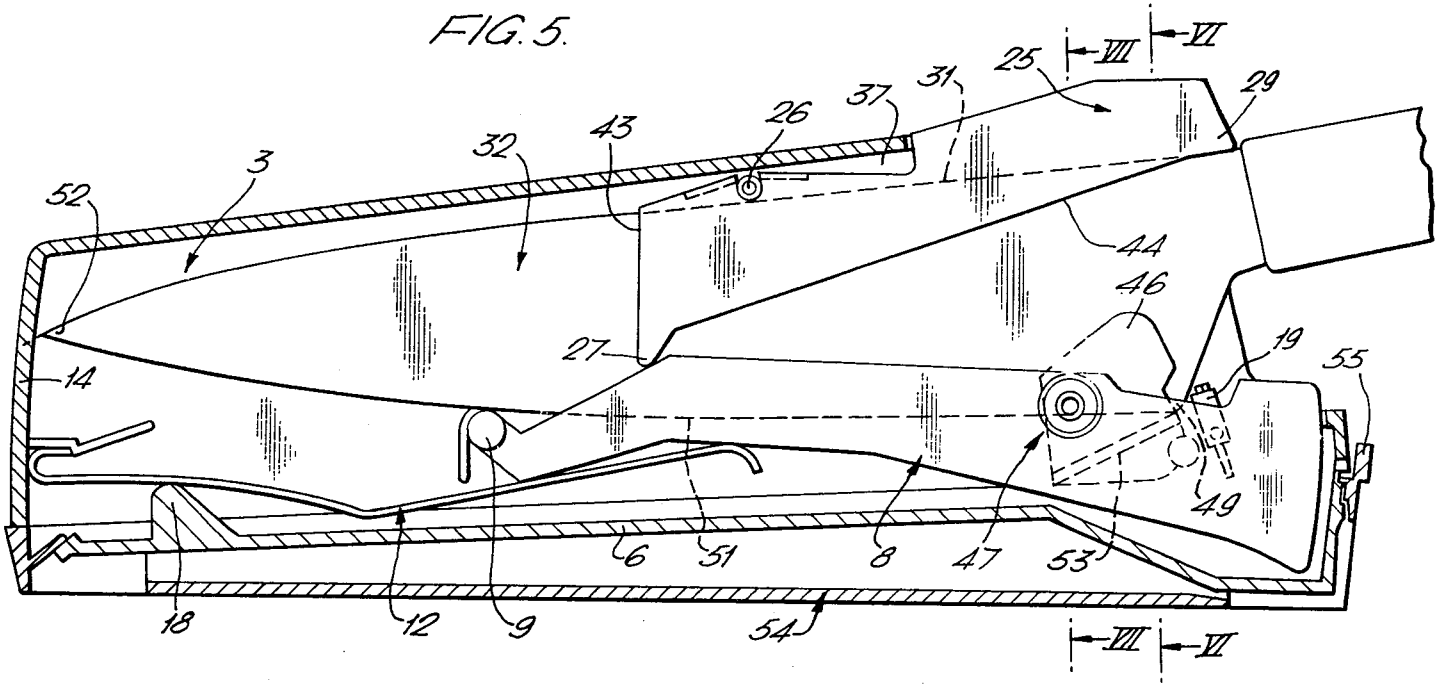
FIG. 5 is a view similar to FIG. 1 but showing the parts in the positions adopted when a knife blade is inserted into the housing.

Guiding of the knife blade 32 to resist lateral tilting during sharpening, is preferably effected by laterally spaced guide wings 46 attached to the carrier 8 to move therewith, and located slightly rearwardly of the sharpening device 19 (see FIGS. 1 and 5). The arrangement is preferably such that the knife blade is subjected to the restraining influence of the guide wings 46 very shortly after engaging the sharpening device 19. Each guide wing 46 may be formed integrally with the carrier 8 or separately attached thereto (as in the construction shown), and in the later case it is preferred that both form part of a single structure 47 which is located and retained within an appropriately shaped cavity 48 in the carrier 8 (see FIGS. 3 to 7). The guide structure 47 may be moulded or otherwise formed from a plastics material, as can the other components such as the housing 2, carrier 8 and reaction member 25.

It is a feature of the preferred construction shown, that a knife blade 32 can be inserted into the housing 2 to a sufficient depth for the choil or heel 49 of the blade 32 to pass beyond the sharpening device 19, or at least the sharpening elements of that device 19 (see FIG. 5). In that way, substantially the full length of the cutting edge 51 can be sharpened, particularly as the tip 52 of the blade 32 is urged into contact with the sharpening device 19 because of the closed condition of the scabbard at the time of initial insertion of the blade 32. The movement of the choil 49 beyond the sharpening device 19 need not be great, and a rest 53 is provided to engage the blade cutting edge 51, preferably adjacent the choil 49 to support the blade 32 in a suitable position for withdrawal back over the sharpening device 19. The rest 53 may be a platform or wedge extending across the blade receiving slot in the carrier 8, but in the preferred arrangement shown, it is formed integrally with and interconnects the guide wings 46 of the guide structure 47.

If desired, the last described feature of a blade rest, can be utilized in a scabbard – sharpener combination without the other features described earlier in this specification. That is, the feature can be applied to a sharpener as disclosed in either of the prior U.S. Pat. Nos. 3,676,961 and 3,774,350.

The housing 2 of the present construction may be arranged for attachment to a support in substantially the same manner as described and illustrated in U.S. Pat. No. 3,774,350. That is, the main body part of the housing 2 may be releasably attached to a base structure 54 through a latch device 55, and the base structure 54 can be secured to a support in any suitable manner.

It will be appreciated from the foregoing description that the invention provides several advantages over prior construction, and these advantages are achieved in a relatively simple manner. The ability to sharpen the full length of a knife blade is valuable, as is the ability of the scabbard to accept blades of various depths. Another advantage arises out of the substantially constant torque which is applied to the carrier by the biasing spring, regardless of the carrier position.

Various alterations, modifications and/or additions may be incorporated into the invention particularly described without departing from the spirit or scope of the invention as defined by the appended claims. I claim:

1. A knife sharpener including: a hollow enlongate housing having an access opening at a front end thereof; a carrier member located within said housing so as to extend generally lengthwise thereof and having a rear end portion pivotally connected to the housing at a location spaced rearwardly from said access opening, the axis of said carrier pivot extending transverse to the longitudinal axis of said housing so that pivotal movement of said carrier causes a front end portion thereof to be moved away from and towards an upper wall of said housing; a sharpening device mounted on said carrier front end portion adjacent said access opening; biasing means urging said carrier member to pivot towards said housing upper wall; and a reaction member at least partially located within said housing so as to be disposed between the upper surface of said carrier member and said housing upper wall and being pivotally connected to said housing for movement about an axis extending substantially parallel to said carrier pivot axis and which is located between the last said axis and said access opening; said reaction member having a rear section engaging said carrier upper surface at a location between the two said pivots, and a front end portion overlying that upper surface adjacent said access opening; the arrangement being such that a knife blade inserted into said housing through said access opening and engaging said sharpening device, causes separation of the front end portions of the two said members, but said rear section of the reaction member remains in engagement with said carrier member during the resulting pivotal movement of each of the two said members.

2. A knife sharpener according to claim 1, wherein said biasing means acts on an underside of said carrier member at a location between said sharpening device and said carrier pivot, and in all pivotal positions of both said members said rear section of the reaction member bears on said carrier upper surface between said carrier pivot and the line of action of the force applied to said carrier member by said biasing means.

3. A shapening device according to claim 1, wherein said reaction and carrier members combine to substantially close said access opening when there is no knife blade between the two said members, and an opening is provided through a front end portion of said housing upper wall so that said reaction member can project therethrough when the front end portions of the two said members are separated.

4. A knife sharpener according to claim 1, wherein a blade rest is provided on said carrier member rearwardly of said sharpening device and at a location such as to engage and support a knife blade inserted into the housing to an extent such that the entire sharpening edge of the blade is located rearwardly of said sharpening device.

* * * * *